United States Patent [19]

Montesanto et al.

[11] Patent Number: 4,623,858

[45] Date of Patent: Nov. 18, 1986

[54] QUICK CONNECT WAVEGUIDE COUPLER

[75] Inventors: Ernest C. Montesanto, San Jose; Joseph K. Martin, Boulder Creek, both of Calif.

[73] Assignee: Ford Aerospace & Communications Corporation, Detroit, Mich.

[21] Appl. No.: 691,684

[22] Filed: Jan. 15, 1985

[51] Int. Cl.[4] ..... H01P 1/04

[52] U.S. Cl. ..... 333/255; 339/90 C

[58] Field of Search ..... 333/254, 255; 339/90 R, 339/90 C; 138/111, 114, 155

[56] References Cited

U.S. PATENT DOCUMENTS

| | | | |
|---|---|---|---|
| 2,462,370 | 2/1949 | Drake . | |
| 2,785,384 | 3/1957 | Wickesser | 339/90 C X |
| 2,788,498 | 4/1957 | Hardaway | 333/254 |
| 2,862,728 | 12/1958 | Druschel et al. . | |
| 3,008,116 | 11/1961 | Blanchenot . | |
| 3,049,690 | 8/1962 | Sparber | 339/90 C X |
| 3,076,159 | 1/1963 | Vaughan et al. | 333/255 |
| 3,076,948 | 2/1963 | Misner . | |
| 3,149,295 | 9/1964 | Grebe | 333/254 |
| 3,351,886 | 11/1967 | Zimmerman, Jr. . | |
| 3,393,927 | 7/1968 | Kelly et al. . | |
| 3,750,087 | 7/1973 | Vetter . | |
| 3,821,670 | 6/1974 | Thompson . | |
| 3,835,443 | 9/1974 | Arnold et al. . | |
| 4,181,905 | 1/1980 | Bouvard et al. . | |
| 4,415,213 | 11/1983 | Punako et al. | 339/90 R X |

FOREIGN PATENT DOCUMENTS

| | | | |
|---|---|---|---|
| 876394 | 8/1961 | United Kingdom | 333/255 |

OTHER PUBLICATIONS

Microwave Components section of the 1980 English Electric Corporation catalog at p. 876.

Waveguide clamp section of the 1983 Astrolab, Inc. Catalog at p. 3222.

1983–1984 Airtron Microwave Components and Waveguide catalog at pp. 38 and 39.

*Primary Examiner*—Paul Gensler

*Attorney, Agent, or Firm*—Edward J. Radlo; Clifford L. Sadler

[57] ABSTRACT

A waveguide coupler for quickly, easily, and reliably coupling and decoupling two waveguide sections (1A, 1B). The ends (17A, 17B) of the waveguide sections (1A, 1B) are translationally aligned by means of closely fitting coaxial cylindrical shells (41, 21) surrounding the waveguide ends (17A, 17B, respectively). The ends (17A, 17B) are recessed within the shells (41, 21, respectively). A freely rotatable cylindrical sleeve (31) is axially positioned around one of the waveguide ends (17B) by means of a retaining means (13). Less than one revolution of the sleeve (31) is sufficient to effectuate coupling or decoupling of the waveguide sections (1A, 1B), by means of a set of substantially identical helical grooves (34) within the inner surface of the sleeve (31) engaging pins (49) protruding from one of the shells (41). A wavespring (35) fitting within the inner surface of the coupling sleeve (31) is tensioned to achieve a fixed and preselected unit preload on the coupling surface (51), said preload based upon electromagnetic considerations.

10 Claims, 3 Drawing Figures

QUICK CONNECT WAVEGUIDE COUPLER

TECHNICAL FIELD

This invention pertains to the field of waveguide couplers for coupling and decoupling two waveguides carrying electromagnetic energy at typically microwave frequencies.

BACKGROUND ART

Waveguide couplers of the prior art are bulky, complicated and usually consist of loose parts which may be lost and do not lend themselves to rapid coupling and decoupling. Such prior art waveguide couplers are illustrated in the Microwave Components section of the 1980 English Electric Corporation catalog at p. 876, the waveguide clamp section of the 1983 Astrolab, Inc. catalog at p. 3222, and the 1983–1984 Airtron Microwave Components and Waveguide Catalog at pp. 38 and 39.

Other waveguide couplers are disclosed in U.S. Pat. Nos. 2,862,728; 3,076,948; 3,821,670; and 4,181,905.

U.S. Pat. No. 2,862,728 discloses a waveguide coupler that differs from the present invention in that: (a) It uses a multiturn engaging means having threads 7, as opposed to sleeve 31 of the instant invention, which engages in less than one revolution. As a consequence, the coupling and uncoupling is much slower. Furthermore, the threads are easily damaged. (b) It is not watertight. (c) It uses four latching dogs 3, rather than helical grooves and pins, to draw flanges together. As a result, wear and indentation of the dog contact points can gradually diminish the holding pressure and the integrity of the face contact essential for good electromagnetic performance. On the other hand, the present invention uses spring 35 to maintain a preselected unvarying face pressure which is not dependent upon the experience of the operator. (d) Polarization (circumferential) alignment is achieved with pins 14 engaging waveguide flange holes 22, which can become clogged, rendering engagement difficult. The present invention advantageously dispenses with these by achieving circumferential alignment with keys 27 and keyways 42 that are not part of the waveguide bodies themselves, and tend to be self cleaning every time the coupler is used. (e) One of the waveguide ends is exposed to mechanical damage, whereas in the present invention, both mating surfaces 17A, 17B are recessed.

The waveguide coupler disclosed in U.S. Pat. No. 3,076,948 has a pressure plate 1 which is loose (and thus can easily get lost in the field) and has external threads, which can be easily damaged, rendering the coupler useless. Backup plate 3 and nut 4 are not only loose and can move down the waveguide, but require substantial rearward axial clearance for engagement. The reference's multiturn threads require considerable torque for engagement (which can twist and deform the waveguide), make for a time consuming and inconvenient engagement, and also make for a variable face pressure, depending upon how much nut 4 is tightened. On the other hand, the present invention's spring 35 pressure gives a fixed coupling force, important for electromagnetic transmission. The waveguide faces of the reference device are not recessed as in the present invention, and thus can easily be damaged.

U.S. Pat. No. 3,821,670 discloses a waveguide coupler differing from that of the present invention in that: (a) It uses a multiturn engagement means, and therefore is relatively inconvenient to use. (b) Its engagement means uses threads which can be easily damaged. (c) It has loose parts which can get lost. (d) The face pressure is dependent on how much the engagement ring is tightened. This tightening torque can be considerble, and its transfer to the waveguide can damage the waveguide. (e) The mating faces of the waveguide are exposed, not recessed.

U.S. Pat. No. 4,181,905 discloses a waveguide coupler differing from that of the present invention in that: (a) It is not water tight. (b) It requires considerable axial space behind the flange for its operation. (c) The waveguide mating surfaces are not recessed and can be easily damaged during repeated coupling/uncoupling operations. (d) Circumferential alignment is achieved by screw heads engaging recessed holes which can be clogged by debris, rendering the coupler useless.

Secondary references are U.S. Pat. Nos. 2,462,370; 3,008,116; 3,351,886; 3,393,927; 3,750,087; and 3,835,443.

U.S. Pat. No. 2,462,370 discloses a connector for coupling a waveguide to a large cavity of an oscillator tube. It differs from the coupler of the present invention in that: (a) Many turns are needed for engagement. (b) It has threads which can be easily damaged, thus preventing coupling of the two members. (c) It connects waveguide to an oscillator tube as opposed to connecting two waveguides together. (d) It is not water tight. (e) The cavity is aligned with a key 10 that is part of the waveguide flange, which can undesirably lead to buildup of foreign matter in the vicinity of the waveguide. (f) One waveguide surface is exposed to damage because it is not recessed.

U.S. Pat. No. 3,008,116 discloses a coupler for connecting two multi-wire cables. No suggestion is made that this coupler can be used to couple waveguide sections. Water seal 154 is located in the shell 20, leaving the faces of the cable ends (blocks 24 and 80) in noncontacting proximity. This is not suitable for the coupling of waveguide. The present invention brings waveguide ends 17A, 17B together intimately at surface 51 for good electromagnetic performance, and simultaneously provides a water sealing contact 19 between said ends 17A, 17B themselves.

The reference device requires a large amount of pre-engagement of barrel 66 into shell 20 to help pins 16 engage without binding. The present invention does not require as much axial distance for engagement; it does not engage weak pins, but rather aligns keys 27 and keyways 42.

U.S. Pat. No. 3,351,886 shows a connector for multiwire cable. No suggestion is made that this device can be used for waveguide coupling. The reference device requires significant pre-engagement to align the two members before the pins engage the sockets. The axial distance required for engagement and withdrawal is therefore great. The present invention minimizes this axial distance.

U.S. Pat. No. 3,393,927 shows a "bayonet" coupler for aligning and drawing together separable electrical connectors, with no mention made of any applicability to waveguide.

U.S. Pat. No. 3,750,087 discloses a vibration resistant bayonet coupler for multipin electrical connectors. No suggestion is made of applicability to waveguide.

U.S. Pat. No. 3,835,443 discloses an RFI/EMI shield.

DISCLOSURE OF INVENTION

The present invention is a waveguide coupler for quickly, easily, and reliably coupling and decoupling two waveguide sections (1A, 1B). The ends (17A, 17B) of the waveguide sections (1A, 1B) are substantially flat and are aligned by alignment means not associated with the waveguide section ends (17A, 17B) themselves. This alignment means prevents translational misalignments, and in the preferred embodiment consists of a set of keys (27) and keyways (42) associated with cylindrical shells (21, 41, respectively) fixedly mounted on preferably cylindrical bodies (3B, 3A, respectively) surrounding the waveguide sections (1B, 1A, respectively). If the polarization in the radiation conveyed by the waveguide sections (1A, 1B) or if external mechanical considerations dictate, the alignment means includes an unambiguous circumferential alignment means, e.g., a pattern of keys (27) and keyways (42) that is asymmetrical.

The two waveguide sections (1A, 1B) are drawn together by an engaging means (31) in the form of a freely rotatable cylindrical sleeve surrounding one of the bodies (3B). Engagement and disengagement of the sections (1A, 1B) is accomplished by turning the sleeve (31) just a portion of one revolution. The interior surface of the sleeve (31) is, in the preferred embodiment, indented with a series of substantially identical helical grooves (34) which track on associated pins (49) protruding from the shell (41) of the body (3A) on which the sleeve (31) is not initially mounted. A wavespring (35) is positioned within the sleeve (31) to maintain, during the coupling process, a constant preload on the coupling surface (51), where said preload is tailored to the electromagnetic requirements of the waveguide sections (1A, 1B).

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
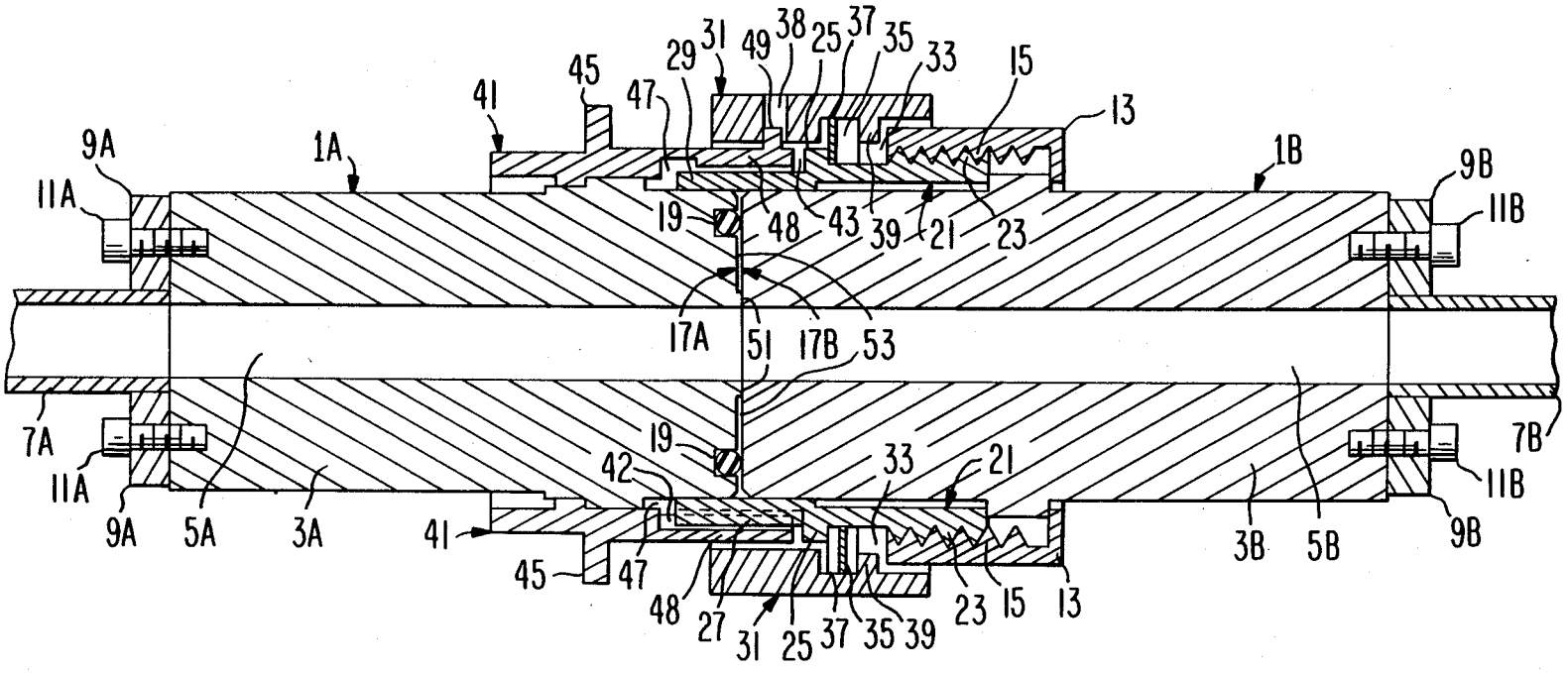
FIG. 1 is a side cross-sectional view of the coupler of the present invention, in which waveguide sections 1A, 1B are in the coupled condition.

Each waveguide section 1A, 1B consists of a standard section of waveguide (7A, 7B, respectively) coupled to an enlarged electrically conducting body (3A, 3B, respectively). Each body 3A, 3B terminates in a substantially flat end (17A, 17B, respectively). Each body 3A, 3B comprises a mass of material such as aluminum, formed around a waveguide cavity (5A, 5B, respectively), for mounting components of the coupler. Each body 3A, 3B can be coupled to its associated conventional portion of waveguide (7A, 7B, respectively) by means of conventional flanges (9A, 9B, respectively) and mounting screws (11A, 11B, respectively). See FIG. 1.

The waveguide cavities 5A, 5B have a rectangular cross-section, as in the embodiment illustrated herein, or a circular cross-section, depending upon the application. Fixedly mounted to each body 3A, 3B or integrally machined therewith is a cylindrical shell (41, 21, respectively). Each shell 41, 21 has a portion (48, 29, respectively), which protrudes beyond its associated waveguide section end (17A, 17B, respectively), advantageously protecting said end 17A, 17B from mechanical damage.

One of the shells, shell 41 in the example illustrated herein, has an inner diameter slightly greater than the outer diameter of the other shell, shell 21, so that shell 21 fits closely within shell 41 when the waveguides 1A, 1B are coupled. Small axial gaps 43, 47 separate the shells 41, 21 from each other when the waveguides 1A, 1B are coupled. These gaps 43, 47 enable wavespring 35 to exert the proper unit load on the coupling surface 51 between the sections 1A, 1B, thereby maintaining the electromagnetic characteristics of the waveguide 1A, 1B.

Figure 2:
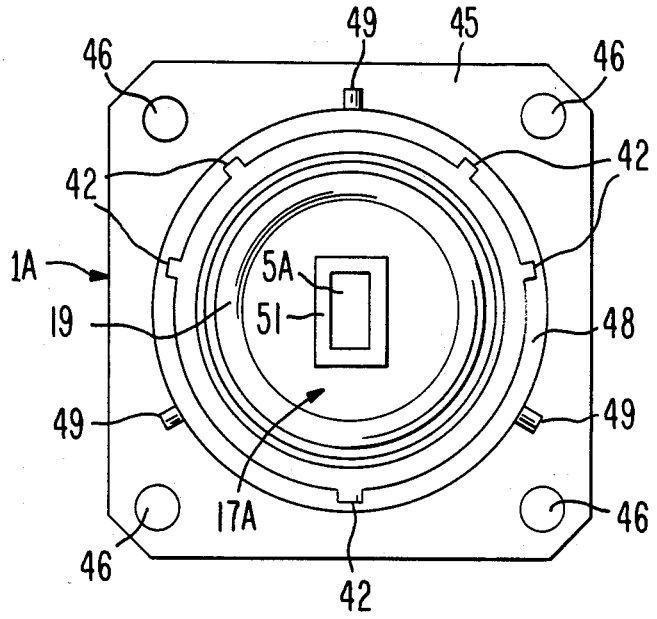
FIG. 2 is an end view of waveguide section 1A of the present invention.

The waveguide ends 17A, 17B must be translationally aligned, since translational (with respect to the plane of FIG. 2) misalignments must be avoided for electromagnetic reasons. This is accomplished by having a close but sliding fit between the outer diameter of shell 21 and the inner diameter of shell 41. For some applications, circumferential alignment of the ends 17A, 17B is not required, e.g., when the waveguide 1A, 1B has circular cross-section cavities 5A, 5B. However, polarization requirements and/or the need to mechanically align adjacent components often dictate that circumferential alignment be employed. This is accomplished in the embodiment illustrated by means of a set of axial keys 27 protruding from the outer surface of shell 21 and sliding into a corresponding set of axial keyways 42 formed around the inner diameter of shell 41. Note that the pattern of these keys 27 and keyways 42, in the plane of FIG. 2 is asymmetric; thus, the circumferential alignment is unambiguous.

Other applications may permit some ambiguity in circumferential alignment, e.g., one with binary (180°) ambiguity. This can be accomplished by utilizing two identical keys 27 positioned 180° apart on the periphery of shell 21, with corresponding keyways 42. Although just one key/keyway 27/42 can be used to accomplish circumferential alignment, the use of a greater number of keys-keyways 27/42 advantageously distributes wear.

The use of keys 27 and keyways 42 permits engagement of the shells 21, 41 in a blind fashion, which may be important for certain applications. Furthermore, this type of alignment tends to be self-cleaning, and is thus perferable to those prior art couplers using fragile pins protruding from waveguide ends, which pins can be easily bent, broken, or clogged with ice.

A rubber or other compressible seal ring 19 is positioned within a generally toroidal indentation in one of the waveguide ends (here 17A). Seal ring 19 compresses slightly when the waveguides 1A, 1B are in the coupled condition. Seal ring 19 advantageously keeps moisture out of the cavities 5A, 5B, and keeps any waveguide conditioning medium, e.g., nitrogen gas or dry air, within cavities 5A, 5B. Both features are important for electromagnetic reasons. Apart from the seal ring 19, the only point of contact of the two waveguide ends 17A, 17B is along a relatively small raised mating surface 51 which is formed around the termination of at least one of the cavities (here 5A). Thus, an axially short gap 53 exists between this mating surface 51 and seal ring 19.

A protruding flange 45 extends radially outward from the cylindrical portion of shell 41. Flange 45 can be used for optional bolting of section 1A to an external component or chassis by means of mounting holes 46 (FIG. 2), thereby holding section 1A rigidly to the chassis to resist the coupling and uncoupling forces.

A region of the outer surface of shell 21 remote from end 17B is threaded with threads 23, which mate with corresponding threads 15 within the inner surface of a retaining nut 13 having the outer shape of a cylinder. Nut 13 is screwed onto shell 21 after engagement sleeve 31 has been positioned over shell 21. Shoulder 25 on shell 21 enables wavespring 35 to exert force on shell 21. The purpose of nut 13 is to keep sleeve 31 from falling off body 3B, while permitting sleeve 31 to rotate freely about body 3B. Thus, there is an axially small gap 33 between shoulder 39 of sleeve 31 and nut 13 even when nut 13 is in the fully tightened position. A retaining pin or pins could be used in place of nut 13 for this purpose.

Engagement of the ends 17A, 17B is accomplished by means of substantially identical helical grooves 34 within the inner surface of sleeve 31, which grooves ride on pins 49 protruding from the outer surface of shell 41. During engagement, sleeve 31 exerts force on body 3B by its shoulder 39 pushing on shoulder 25 via wavespring 35.

Figure 3:
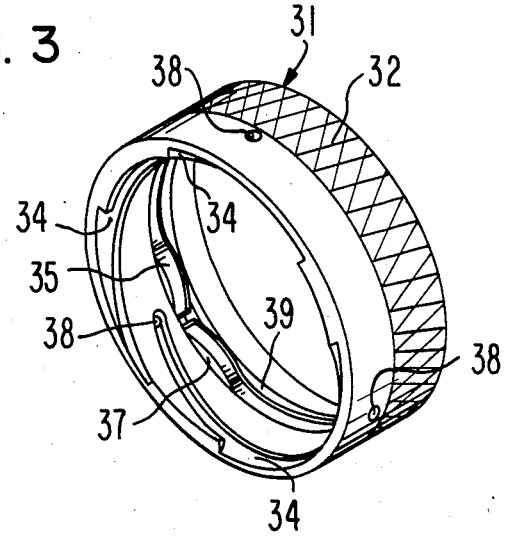
FIG. 3 is an isometric view of sleeve 31 of the present invention.

FIG. 3 shows three helical grooves 34 indented into the inside surface of sleeve 31. Regardless of the number of grooves 34, each groove 34 has a corresponding pin 49. In general, it is desirable to have many grooves 34, to circumferentially equalize the coupling force. On the other hand, the greater the number of grooves 34, the shorter the length and steeper the helix angle (the angle between the groove 34 and the circular end of sleeve 31) of each groove 34, since the grooves 34 cannot cross each other. This increases the torque required to deflect spring 35.

In contrast with the case of the keys 27 and keyways 42, the circumferential arrangement of grooves 34 and pins 49 must be symmetric, because it is desirable to start the coupling process anywhere within the rotational period of sleeve 31. In the illustrated embodiment, each groove 34 length is approximately 120° and the amount of rotation of sleeve 31 needed to effectuate coupling is no more than 120°. This less than 360° rotation makes for quicker coupling and decoupling than with prior art couplers using threaded fittings requiring many full revolutions.

FIG. 3 shows that the ramp angle of each helical groove 34 is constant along the length of the groove 34; however, this angle can be varied as desired to vary the required coupling torque, as long as all grooves 34 are substantially identical. Knurling 32 is formed on the outside surface of sleeve 31 to assist in manual coupling and decoupling. Alternative to knurling 32, the outer surface of sleeve 31 can be extended radially to form a handle or contain lobes to facilitate turning.

Each groove 34 terminates in a detent 38, in this case in the shape of a cylindrical hole, that slightly extends the groove 34 in the counter-direction, i.e., in the axial direction away from spring 35. The effect is to slightly relieve the tension of spring 35 and inhibit unintentional decoupling of sections 1A, 1B, i.e., manual counter torque on sleeve 31 is required to effectuate the decoupling maneuver.

A wave spring 35 fits within a roughly toroidal recess 37 formed within the inner surface of sleeve 31. Spring 35 is perferably made of steel; its waves are orthogonal to the sleeve 31 inner surface. Spring 35 compresses between circumferential shoulder 25, protruding radially outwardly from the outer surface of shell 21, and circumferential shoulder 39 protruding radially inwardly from the inner surface of sleeve 31. The compression force of the spring 35, in combination with the axial positioning of the shoulders 25, 39 and pins 49, determines the coupling pressure at the mating surface 51 when the sections 1A, 1B are coupled. For electromagnetic reasons, it is desired to have a high unit load at the mating surface 51, between the waveguide sections 1A, 1B, to keep the electromagnetic energy contained therewithin. Since the locking of the pins 49 within the detents 38 is unambiguous, the amount of this unit load is fixed and determinate, which is desirable for electromagnetic purposes.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A coupler for coupling two sections of waveguide, each section dimensioned to carry electromagnetic energy and terminating in a substantially flat end, said coupler comprising:

means for translationally aligning the two waveguide section ends as said ends are brought into intimate contact; and surrounding one of the waveguide sections, freely rotatable means for engaging the two waveguide sections by rotating said engaging means less than 360°; wherein the aligning means comprises first and second coaxial cylindrical shells;

the inner diameter of the first shell is slightly larger than the outer diameter of the second shell;

the first shell is fixedly mounted with respect to one of said waveguide sections;

the second shell is fixedly mounted with respect to the other of said waveguide sections;

the second shell fits closely within the first shell when the waveguide sections are in the coupled condition; and each waveguide section end is recessed within one of said shells.

2. The coupler of claim 1 wherein said aligning means further comprises means for achieving unambiguous circumferential alignment of the two waveguide section ends.

3. The coupler of claim 1 further comprising waterproofing means mounted on one of said waveguide sections ends, wherein the waterproofing means abuts the other of said waveguide section ends when the waveguide sections are in the coupled condition.

4. The coupler of claim 1 further comprising, associated with one of said waveguide sections, removable means for maintaining the axial position of the engaging means about said section while allowing uninhibited rotation of said engaging means.

5. The coupler of claim 1 wherein each waveguide section surrounds a cavity having a rectangular cross-section.

6. The coupler of claim 1 wherein each waveguide section surrounds a cavity having a circular cross-section.

7. A coupler for coupling two sections of waveguide, each section dimensioned to carry electromagnetic energy and terminating in a substantially flat end, said coupler comprising:

means for translationally aligning the two waveguide section ends as said ends are brought into intimate contact; and surrounding one of the waveguide sections, freely rotatable means for engaging the two waveguide sections by rotating said engaging means less than 360°; wherein the aligning means comprises first and second coaxial cylindrical shells;

the inner diameter of the first shell is slightly larger than the outer diameter of the second shell;

the first shell is fixedly mounted with respect to one of said waveguide sections;

the second shell is fixedly mounted with respect to the other of said waveguide sections;

the second shell fits closely within the first shell when the waveguide sections are in the coupled condition; and the engaging means comprises a cylindrical sleeve having an inner surface indented with several substantially identical helical grooves configured to engage corresponding pins protruding from the first shell.

8. The coupler of claim 7 wherein the helical grooves are equispaced circumferentially within the inner surface of the sleeve.

9. The coupler of claim 7 wherein the engaging means further comprises means for tensioning the waveguide section ends into intimate contact having a preload preselected so that electromagnetic energy traveling within the waveguide sections will not exit the region of contact of said waveguide section ends.

10. The coupler of claim 9 wherein each helical groove terminates in a detent that extends said groove in the axial direction towards the waveguide section around which the sleeve is not mounted; wherein said detent effects a slight relaxation of tension in the tensioning means and inhibits unintentional decoupling of the two waveguide sections.

* * * * *